US008859174B2

(12) United States Patent
Nonaka et al.

(10) Patent No.: US 8,859,174 B2
(45) Date of Patent: Oct. 14, 2014

(54) ELECTROPHOTOGRAPHIC PHOTOSENSITIVE MEMBER, PROCESS CARTRIDGE, AND ELECTROPHOTOGRAPHIC APPARATUS

(75) Inventors: Masaki Nonaka, Suntou-gun (JP); Masato Tanaka, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 13/477,876

(22) Filed: May 22, 2012

(65) Prior Publication Data

US 2012/0301179 A1 Nov. 29, 2012

(30) Foreign Application Priority Data

May 24, 2011 (JP) ..... 2011-115862
Apr. 26, 2012 (JP) ..... 2012-100965

(51) Int. Cl.
*G03G 5/00* (2006.01)

(52) U.S. Cl.
USPC ..... 430/66; 430/56; 399/159

(58) Field of Classification Search
USPC ..... 430/66, 56; 399/159
See application file for complete search history.

(56) References Cited

U.S. PATENT DOCUMENTS 4,444,863 A 4/1984 Sano
5,035,969 A 7/1991 Kondo
6,080,518 A 6/2000 Levin et al.
8,557,488 B2 10/2013 Nagasaka et al.
2006/0019185 A1 1/2006 Amamiya et al.
2006/0110668 A1 5/2006 Kawasaki et al.
2011/0159419 A1 6/2011 Iwamoto et al.
2011/0207041 A1 8/2011 Miyamoto et al.
2012/0301178 A1 11/2012 Nonaka et al.
2013/0137020 A1 5/2013 Nagasaka et al.
2013/0137024 A1 5/2013 Nonaka et al.

FOREIGN PATENT DOCUMENTS

CN 1043575 A 7/1990
CN 001358282 A 7/2002
CN 1410836 A 4/2003
CN 1722004 A 1/2006
CN 001811605 A 8/2006
EP 1198735 B1 4/2002
EP 2219080 A2 8/2010
EP 2328032 A2 6/2011

(Continued)

OTHER PUBLICATIONS

Sharp Technical Journal No. 101, Aug. 2010, Fukushaki gazo furyo no teiryotekina hyoka hoho no kakuritsu (Establishment of quantitative evaluation method of image defects in copying machine).

(Continued)

*Primary Examiner* — Mark A Chapman
(74) *Attorney, Agent, or Firm* — Canon U.S.A., Inc., IP Division

(57) ABSTRACT

An electrophotographic photosensitive member has a surface layer that contains a urea compound having two or more urea moieties. Each of the urea moieties has a carbonyl group and two nitrogen atoms. Each of the two nitrogen atoms connects to an alkyl group and a substituted or unsubstituted aryl group or a substituted or unsubstituted arylene group.

11 Claims, 2 Drawing Sheets

(56) References Cited

FOREIGN PATENT DOCUMENTS

| | | | |
|---|---|---|---|
| JP | 63-097959 | A | 4/1988 |
| JP | 2-230254 | A | 9/1990 |
| JP | 03063657 | A | 3/1991 |
| JP | 08-123055 | A | 5/1996 |
| JP | 2000-066425 | A | 3/2000 |
| JP | 2000-206715 | A | 7/2000 |
| JP | 2000-206716 | A | 7/2000 |
| JP | 2005-062302 | A | 3/2005 |
| JP | 2005115353 | A | 4/2005 |
| JP | 2006010816 | A | 1/2006 |
| JP | 2006047949 | A | 2/2006 |
| JP | 2007-279678 | A | 10/2007 |
| JP | 2009015306 | A | 1/2009 |
| JP | 2010-085832 | A | 4/2010 |
| JP | 2010085832 | A | 4/2010 |
| JP | 2010156835 | A | 7/2010 |
| JP | 2011137983 | A | 7/2011 |
| JP | 2011175188 | A | 9/2011 |
| WF | 2005114331 | A1 | 12/2005 |

OTHER PUBLICATIONS

Frederick D. Lewis, Todd L. Kurth and Weizhong Liu, "Luminescence of extended and folded N,N'-diarylureas", Photochem,Photobiol,Sci.,2002,1,p. 30-37.

Robert A. Batey, V. Santhakumar, Chiaki Yoshina-Ishii, Scott D. Taylor, "An Efficient New Protocol for the Formation of Unsymmetrical Tri- and Tetrasubstituted Ureas" ,Tetrahedron Letter 39(1998) p. 6267-6270.

Kin-ya Akiba, Satoru Matsunami, Chikahiko Eguchi, and Naoki Inamoto, "Chemistry of Nitrosoimines. VI. Attempted Syntheses of Some Resonance Stabilized Nitrosoimines and Their UV Spectra", Bulletin of the Chemical Society of Japan,vol. 47(4),1974, p. 935-937.

Ernst Bergmann and A. Weitzmann, "The Structure of Urea and Its Derivatives" Transaction of the Faraday Society,34,1938,p. 783-786.

U.S. Appl. No. 13/477,492, filed May 22, 2012, Hideaki Nagasaka.

U.S. Appl. No. 13/477,561, filed May 22, 2012, Hideaki Nagasaka.

U.S. Appl. No. 13/477,821, filed May 22, 2012, Masaki Nonaka.

U.S. Appl. No. 13/477,410, filed May 22, 2012, Masato Tanaka.

Diamond, A.S., ed., "Handbook of Imaging Materials", Marcel Dekker, Inc., NY (1991),pp. 395-396.

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member and to a process cartridge and an electrophotographic apparatus each including the electrophotographic photosensitive member.

2. Description of the Related Art

One example of an electrophotographic photosensitive member installed in an electrophotographic apparatus is an organic electrophotographic photosensitive member containing an organic photoconductive substance (charge generating substance) (hereinafter referred to simply as an "electrophotographic photosensitive member"). Electrophotographic photosensitive members have been widely studied. In recent years, for the purpose of extending the life of an electrophotographic photosensitive member and improving image quality, it has been desired to improve image deletion in response to an improvement in the mechanical durability (abrasion resistance) of the electrophotographic photosensitive member.

Image deletion is a phenomenon in which a blurred electrostatic latent image results in a blurred output image. It is believed that the reason for image deletion is that discharge products resulting from charging remaining on the surface of an electrophotographic photosensitive member change the characteristics of the constituent materials of the surface of the electrophotographic photosensitive member.

Image deletion may be reduced by using an electrophotographic photosensitive member that contains an additive agent. Japanese Patent Laid-Open No. 2007-279678 proposes a method for preventing image deletion by providing a surface layer containing a curable resin of an electrophotographic photosensitive member with a particular amine compound. Japanese Patent Laid-Open No. 63-097959 proposes the addition of a urea compound to a photosensitive layer to prevent deterioration of an electrophotographic photosensitive member caused by an active gas.

However, the present inventors found that the amine compound described in Japanese Patent Laid-Open No. 2007-279678 tends to reduce the electric potential stability of the electrophotographic photosensitive member and has an insufficient image deletion preventing effect. The urea compound described in Japanese Patent Laid-Open No. 63-097959 has an insufficient image deletion preventing effect and tends to decrease electric potential stability.

SUMMARY OF THE INVENTION

The present invention provides an electrophotographic photosensitive member that includes a support and a photosensitive layer provided on the support. The electrophotographic photosensitive member has excellent electric potential stability and reduces image deletion. The present invention also provides a process cartridge and an electrophotographic apparatus each including the electrophotographic photosensitive member.

These can be achieved by the present invention.

The present invention relates to an electrophotographic photosensitive member that includes a support (electroconductive support) and a photosensitive layer provided on the support. The electrophotographic photosensitive member has a surface layer that contains a urea compound having two or more urea moieties. Each of the urea moieties has a carbonyl group and two nitrogen atoms. Each of the two nitrogen atoms connects to an alkyl group and a substituted or unsubstituted aryl or a substituted or unsubstituted arylene group.

The present invention also provides a process cartridge detachably attachable to the main body of an electrophotographic apparatus. The process cartridge integrally supports the electrophotographic photosensitive member and at least one device selected from the group consisting of a charging device, a developing device, a transferring device, and a cleaning device.

The present invention also provides an electrophotographic apparatus that includes the electrophotographic photosensitive member, a charging device, an exposure device, a developing device, and a transferring device.

The present invention can provide an electrophotographic photosensitive member that includes a support and a photosensitive layer provided on the support. The electrophotographic photosensitive member has excellent electric potential stability and reduces image deletion. The present invention can also provide a process cartridge and an electrophotographic apparatus each including the electrophotographic photosensitive member.

Further features of the present invention will become apparent from the following description of exemplary embodiments with reference to the attached drawings.

DESCRIPTION OF THE EMBODIMENTS

Figure 1A:
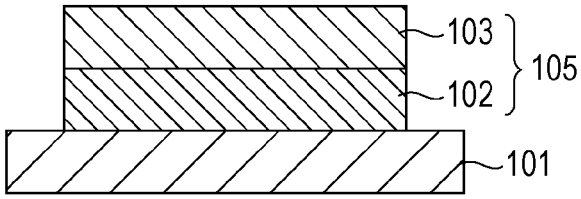
FIGS. 1A and 1B are schematic views of the layer structure of an electrophotographic photosensitive member according to an embodiment of the present invention.

As described above, the present invention provides an electrophotographic photosensitive member that includes an electroconductive support and a photosensitive layer provided on the electroconductive support. The electrophotographic photosensitive member has a surface layer that contains a urea compound having two or more urea moieties. Each of the urea moieties has a carbonyl group and two nitrogen atoms. Each of the two nitrogen atoms connects to an alkyl group and a substituted or unsubstituted aryl group or a substituted or unsubstituted arylene group (connects to an alkyl group and a substituted or unsubstituted aryl or arylene group).

The urea compound may be a compound represented by the following formula (1), a compound represented by the following formula (2), or a compound represented by the following formula (3).

(1)

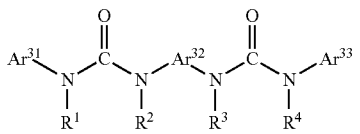

-continued (2)

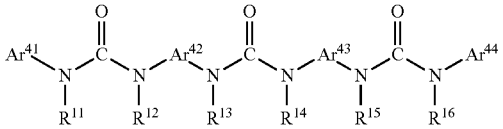

(3)

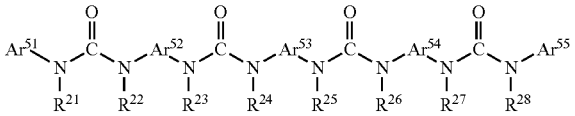

In the formulas (1) to (3), $R^1$ to $R^4$, $R^{11}$ to $R^{16}$, and $R^{21}$ to $R^{28}$ each independently represents an alkyl group. $Ar^{32}$, $Ar^{42}$ to $Ar^{43}$, and $Ar^{52}$ to $Ar^{54}$ each independently represents a substituted or unsubstituted arylene group. $Ar^{31}$, $Ar^{33}$, $Ar^{41}$, $Ar^{44}$, $Ar^{51}$, and $Ar^{55}$ each independently represents a substituted or unsubstituted aryl group. A substituent group of the substituted arylene group may be an alkyl group, an alkoxy-substituted alkyl group, a halogen-substituted alkyl group, an alkoxy group, an alkoxy-substituted alkoxy group, a halogen-substituted alkoxy group, or a halogen atom. A substituent group of the substituted aryl group may be a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

An electrophotographic photosensitive member according to the present invention has excellent electric potential stability and reduces image deletion. The present inventors believe the reason for this as follows.

A technical literature indicates that discharge products remaining on a surface of an electrophotographic photosensitive member react with water in a humid environment to produce nitric acid and causes image deletion (Sharp Technical Journal No. 101, August, 2010, "Fukushaki gazo furyo no teiryotekina hyoka hobo no kakuritsu (Establishment of quantitative evaluation method of image defects in copying machine)"). Nitric acid deposited on the surface layer of the electrophotographic photosensitive member acts on a charge transporting substance in the electrophotographic photosensitive member to produce an ion pair having a relatively long life, which changes the surface resistivity of the surface layer. This can result in an insufficient light area potential at a boundary between an image-forming portion and a non-image-forming portion and consequently a low optical density of the image-forming portion (a blurred image or no image), which is called image deletion.

In a urea compound according to an embodiment of the present invention, the aryl or arylene groups connected to the nitrogen atoms of the urea moieties rather than an aryl group of a charge transporting substance form ion pairs having a relatively short life with nitric acid derived from discharge products. In addition, the urea compound has two or more urea moieties. This can reduce variations in the surface resistivity of the surface layer and provide a sufficient light area potential at a boundary between an image-forming portion and a non-image-forming portion. This will prevent a decrease in the optical density of the image-forming portion and reduce image deletion.

Japanese Patent Laid-Open Nos. 2-230254 and 63-097959 disclose a compound that includes one urea moiety having an N,N,N'-trialkyl group and an N'-aryl group. However, this urea moiety is less reactive with nitric acid derived from discharge products, and the number of urea moieties is one. Thus, the image deletion preventing effect may be insufficient.

Japanese Patent Laid-Open No. 2-230254 discloses an electrophotographic photosensitive member formed of a photoconductive composition containing a particular urea compound but does not suggest an image deletion preventing effect.

The present inventors found that use of a urea compound disclosed in Japanese Patent Laid-Open No. 63-097959 in a surface layer of an electrophotographic photosensitive member results in an insufficient image deletion preventing effect and insufficient electric potential stability.

An electrophotographic photosensitive member according to an embodiment of the present invention has a surface layer that contains a urea compound having two or more urea moieties. Each of the urea moieties has a carbonyl group and two nitrogen atoms. Each of the two nitrogen atoms connects to an alkyl group and a substituted or unsubstituted aryl group or a substituted or unsubstituted arylene group. The urea moieties have the following structure.

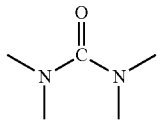

Urea moiety

The urea compound may be a compound represented by the formula (1), a compound represented by the formula (2), or a compound represented by the formula (3).

In the formulas (1) to (3), $R^1$ to $R^4$, $R^{11}$ to $R^{16}$, and $R^{21}$ to $R^{28}$ each independently represents an alkyl group. Examples of the alkyl group include, but are not limited to, a methyl group, an ethyl group, a n-propyl group, a n-butyl group, a n-pentyl group, a n-hexyl group, a n-heptyl group, a n-octyl group, a n-nonyl group, and a n-decyl group. When the alkyl group is a methyl group, an ethyl group, or a n-propyl group, a urea compound according to an embodiment of the present invention does not move to the surface of a surface layer, and the advantages of the present invention can be sufficiently achieved.

In the formulas (1) to (3), $Ar^{32}$, $Ar^{42}$ to $Ar^{43}$, and $Ar^{52}$ to $Ar^{54}$ each independently represents a substituted or unsubstituted arylene group. Examples of the arylene group include, but are not limited to, a phenylene group, a biphenylylene group, a fluorenediyl group, and a naphthylene group. A substituent group of the substituted arylene group may be an alkyl group, an alkoxy-substituted alkyl group, a halogen-substituted alkyl group, an alkoxy group, an alkoxy-substituted alkoxy group, a halogen-substituted alkoxy group, or a halogen atom.

Examples of the alkyl group include, but are not limited to, a methyl group, an ethyl group, and a n-propyl group. Examples of the alkoxy-substituted alkyl group include, but are not limited to, a methoxymethyl group and an ethoxymethyl group. Examples of the halogen-substituted alkyl group include, but are not limited to, a trifluoromethyl group and a trichloromethyl group. Examples of the alkoxy group include, but are not limited to, a methoxy group and an ethoxy group. Examples of an alkoxy-substituted alkoxy group include, but are not limited to, a methoxymethoxy group and an ethoxymethoxy group. Examples of the halogen-substituted alkoxy group include, but are not limited to, a trifluoromethoxy group and a trichloromethoxy group. Examples of the halogen atom include, but are not limited to, a fluorine atom, a chlorine atom, and a bromine atom. When $Ar^{32}$, $Ar^{42}$ to $Ar^{43}$, and $Ar^{52}$ to $Ar^{54}$ each independently represents a phenylene group, this ensures electric potential stability, and the urea compound and nitric acid can preferentially form an ion pair, thereby achieving an excellent image deletion preventing effect. The phenylene group can be a m-phenylene group.

In the formulas (1) to (3), $Ar^{31}$, $Ar^{33}$, $Ar^{41}$, $Ar^{44}$, $Ar^{51}$, and $Ar^{55}$ each independently represents a substituted or unsubstituted aryl group. Examples of the aryl group include, but are not limited to, a phenyl group, a biphenylyl group, a fluorenyl group, and a naphthyl group. A substituent group of the substituted aryl group may be a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

Examples of the dialkylamino group include, but are not limited to, a dimethylamino group and a diethylamino group. Examples of the alkyl group include, but are not limited to, a methyl group, an ethyl group, and a n-propyl group. Examples of the alkoxy-substituted alkyl group include, but are not limited to, a methoxymethyl group and an ethoxymethyl group. Examples of the halogen-substituted alkyl group include, but are not limited to, a trifluoromethyl group and a trichloromethyl group. Examples of the alkoxy group include, but are not limited to, a methoxy group and an ethoxy group. Examples of the alkoxy-substituted alkoxy group include, but are not limited to, a methoxymethoxy group and an ethoxymethoxy group. Examples of the halogen-substituted alkoxy group include, but are not limited to, a trifluoromethoxy group and a trichloromethoxy group. Examples of the halogen atom include, but are not limited to, a fluorine atom, a chlorine atom, and a bromine atom.

When $Ar^{31}$, $Ar^{33}$, $Ar^{41}$, $Ar^{44}$, $Ar^{51}$, and $Ar^{55}$ each independently represents an aryl group or a methyl-, ethyl-, n-propyl-, trifluoromethyl-, methoxy-, dimethylamino-, or fluorine-substituted aryl group, this ensures electric potential stability, and the urea compound and nitric acid can preferentially form an ion pair, thereby achieving an excellent image deletion preventing effect. $Ar^{31}$, $Ar^{33}$, $Ar^{41}$, $Ar^{44}$, $Ar^{51}$, and $Ar^{55}$ can each independently represent a phenyl group.

The urea compounds represented by the formulas (1) to (3) have two or more urea moieties each having a carbonyl group and two nitrogen atoms. Each of the two nitrogen atoms connects to an alkyl group and a substituted or unsubstituted aryl or a substituted or unsubstituted arylene group.

A urea compound represented by the formula (1) may be a compound represented by the following formula (DU-2).

(DU-2)

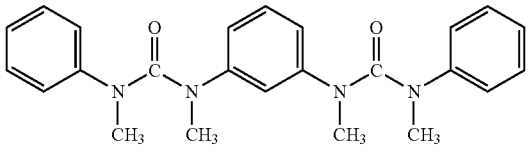

A urea compound according to an embodiment of the present invention may constitute 0.1% by mass or more and 50% by mass or less of the total mass of a surface layer of an electrophotographic photosensitive member. Satisfying this range results in excellent electric potential stability, reduced image deletion, and excellent physical properties of a film.

A surface layer of an electrophotographic photosensitive member may contain one or two or more urea compounds according to an embodiment of the present invention.

A urea compound according to an embodiment of the present invention can be synthesized by a method described in the following literatures.

Photochem. Photobiol. Sci., 2002, 1, P 30-37

Transactions of the Faraday Society, 34, 1938, P 783-786

Tetrahedron Letters 39 (1998) P 6267-6270

Bulletin of the chemical society of Japan, vol. 47 (4), 1974, P 935-937

The following are examples of a urea compound for use in the present invention. However, the present invention is not limited to these examples.

(DU-1)

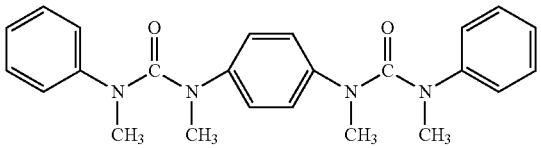

(DU-2)

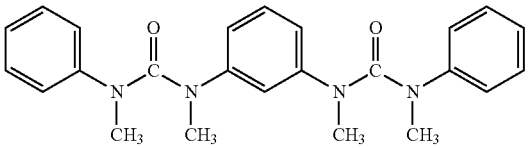

(DU-3)

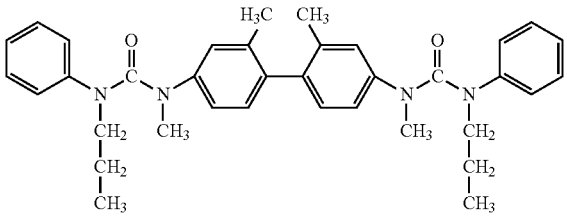

(DU-4)

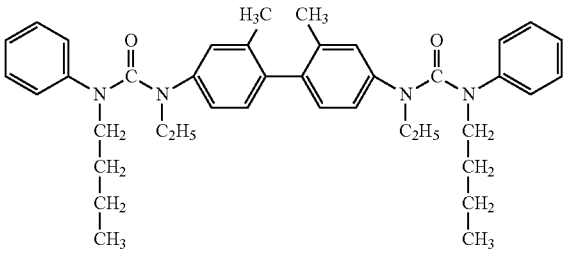

-continued
(DU-5)
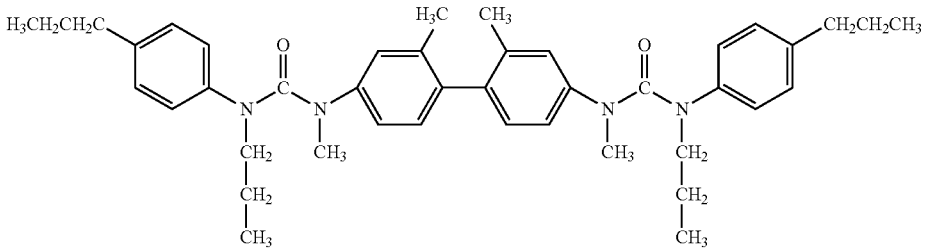
(DU-6)
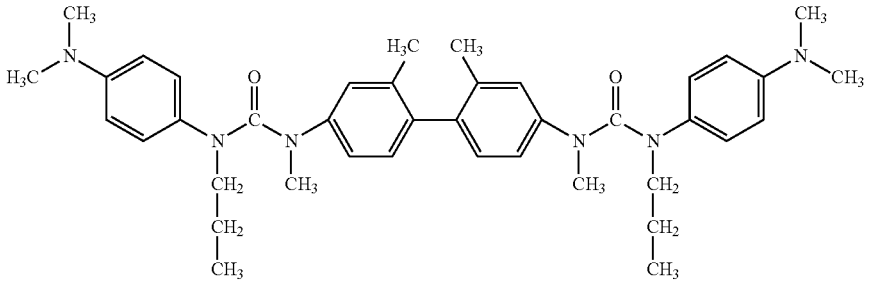
(DU-7)
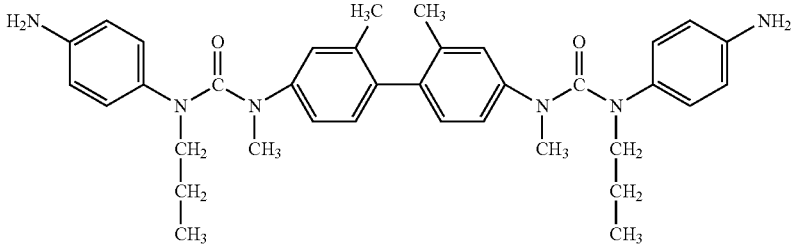
(DU-8)
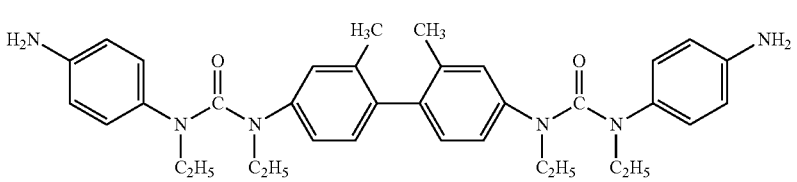
(TU-1)
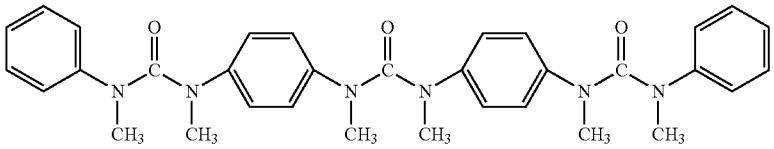
(TU-2)
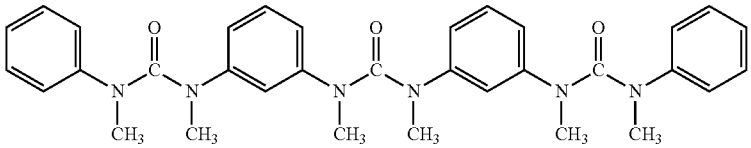
(TU-3)
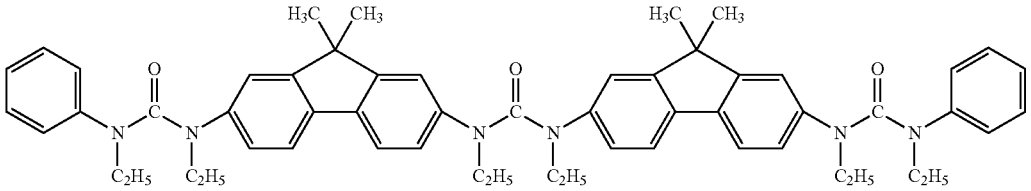

-continued
(TU-4)
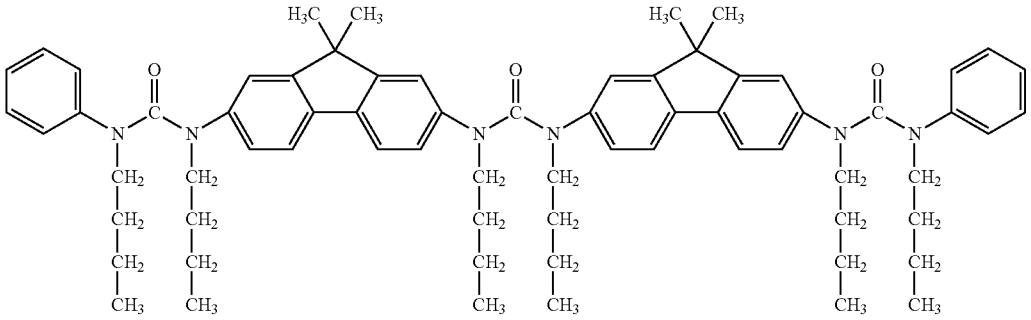
(TU-5)
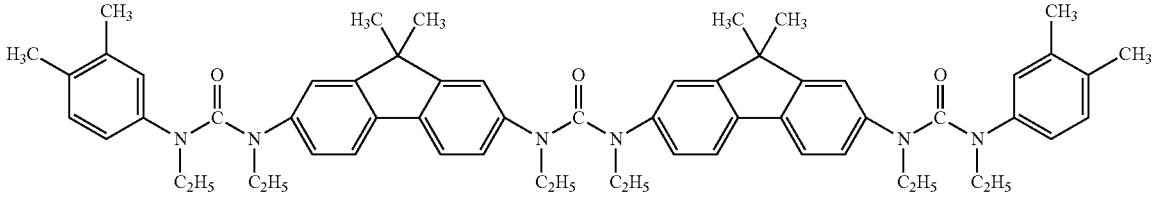
(TU-6)
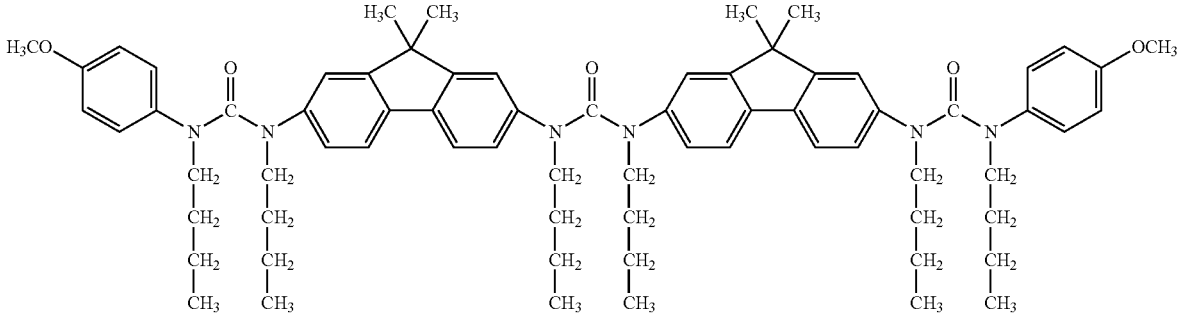
(TU-7)
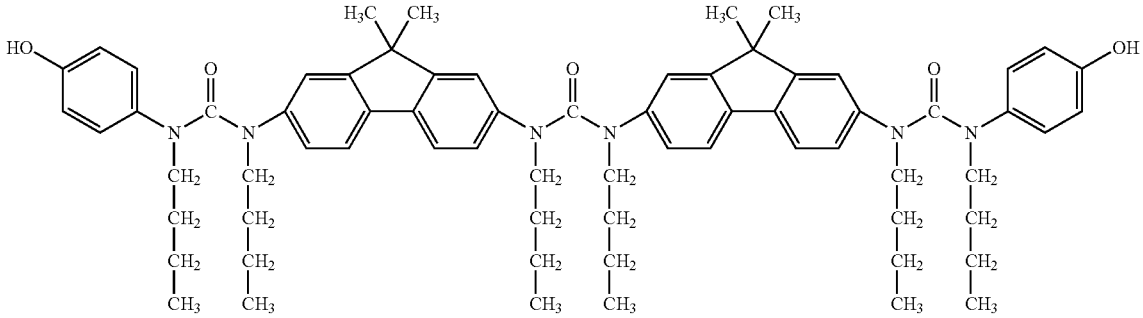
(TU-8)
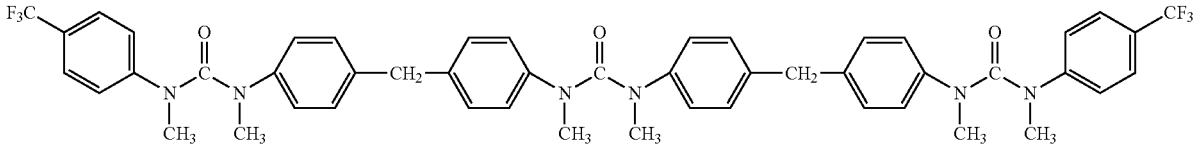
(TeU-1)
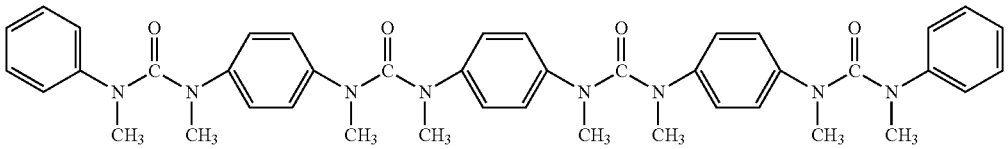

-continued (TeU-2)

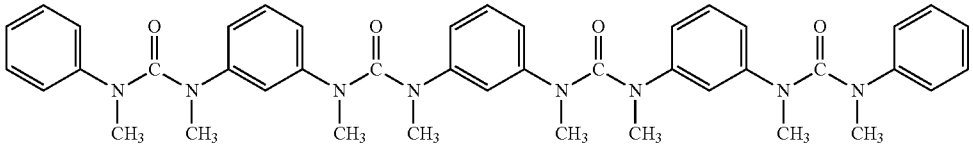

(TeU-3)

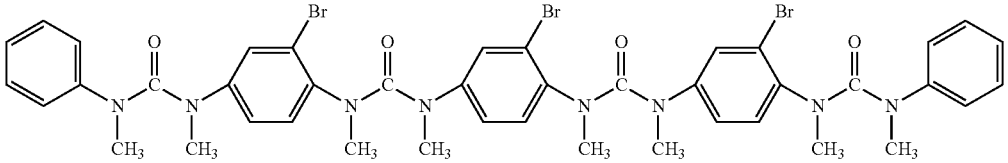

(TeU-4)

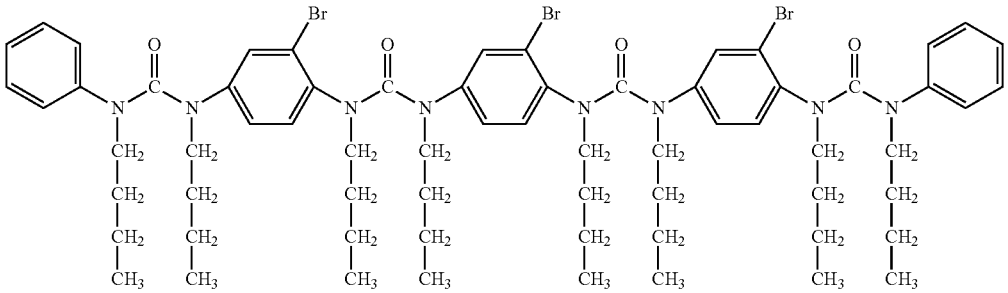

(TeU-5)

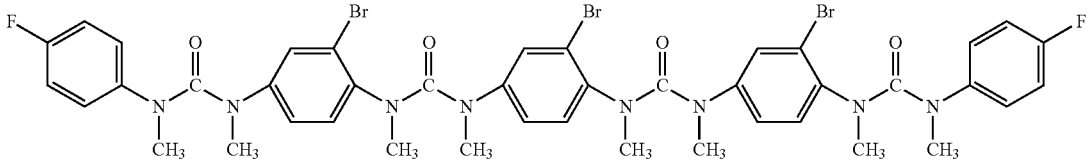

(TeU-6)

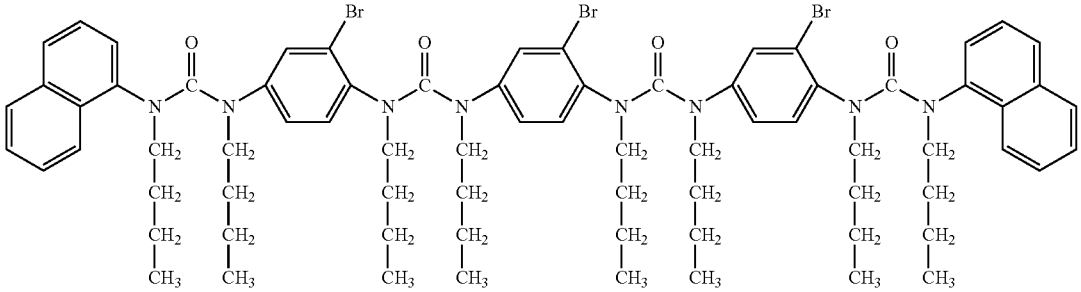

Figure 1B:
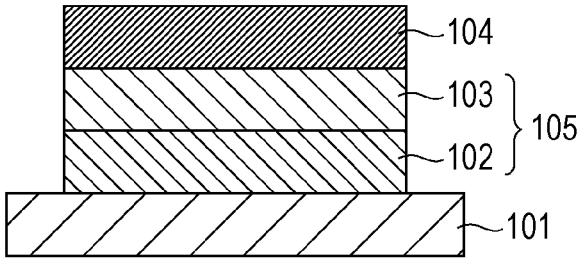

An electrophotographic photosensitive member according to an embodiment of the present invention includes a support and a photosensitive layer provided on the support (FIGS. 1A and 1B). The photosensitive layer may be a monolayer photosensitive layer that contains a charge generating substance and a charge transporting substance or a multilayer (function-separated) photosensitive layer that includes a charge generating layer containing a charge generating substance and a charge transporting layer containing a charge transporting substance. An electrophotographic photosensitive member according to an embodiment of the present invention can have a multilayer photosensitive layer. The charge transporting layer may also have a multilayer structure. The charge transporting layer may be covered with a protective layer.

In FIGS. 1A and 1B, the layer structures include a support 101, a charge generating layer 102, a charge transporting layer 103, a protective layer 104, and a photosensitive layer 105. If necessary, an intermediate layer may be disposed between the support 101 and the charge generating layer 102.

The term "a surface layer of an electrophotographic photosensitive member", as used herein, refers to the outermost layer. In an electrophotographic photosensitive member having the layer structure illustrated in FIG. 1A, the surface layer of the electrophotographic photosensitive member is the charge transporting layer 103. In an electrophotographic photosensitive member having the layer structure illustrated in FIG. 1B, the surface layer of the electrophotographic photosensitive member is the protective layer 104.

In an electrophotographic photosensitive member according to an embodiment of the present invention, a surface layer may be formed by applying a surface-layer coating solution that contains a urea compound according to an embodiment of the present invention, a binder resin, and optionally a charge transporting substance dissolved in a solvent to form a coat and drying the coat. Alternatively, a surface layer may be formed by applying a surface-layer coating solution that contains a urea compound according to an embodiment of the present invention and a compound having a chain-polymerizable functional group dissolved in a solvent to form a coat and polymerizing the compound. In this case, the surface layer contains a polymer produced by the polymerization of the compound having a chain-polymerizable functional group. In order to improve mechanical durability, the surface layer can contain a polymer produced by the polymerization of a compound having two or more chain-polymerizable functional groups per molecule.

The compound having two or more chain-polymerizable functional groups per molecule may be a charge transporting substance. In the case that the charge transporting substance can be used in combination with a polyfunctional monomer (a compound having two or more chain-polymerizable functional groups per molecule and no charge transporting ability) to increase mechanical strength, the charge transporting substance may have only one chain-polymerizable functional group per molecule.

A charge transporting substance is a compound that has charge transporting ability. The charge transporting substance generally has an aryl group or a heteroaryl group and may be an oxazole derivative, an oxadiazole derivative, an imidazole derivative, a triarylamine derivative, styrylanthracene, styrylpyrazoline, phenylhydrazone, a triazole derivative, a triazole derivative, a benzofuran derivative, a benzimidazole derivative, or an N-phenylcarbazole derivative.

A charge transporting substance having a chain-polymerizable functional group can be found in Japanese Patent Laid-Open Nos. 2000-066425, 2000-206715, and 2000-206716. Use of a compound represented by the following formula (5) can result in high mechanical durability and electric potential stability.

(5)

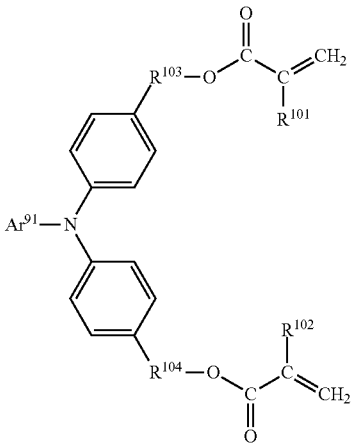

In the formula (5), $Ar^{91}$ denotes an alkyl group, and/or an aryl group optionally having an alkoxy group. $R^{101}$ and $R^{102}$ each independently represents a hydrogen atom or a methyl group. $R^{103}$ and $R^{104}$ each independently represents an alkylene group having 1 to 4 carbon atoms. Examples of the aryl group include, but are not limited to, a phenyl group, a biphenylyl group, and a fluorenyl group. Examples of the alkyl group include, but are not limited to, a methyl group, an ethyl group, a propyl group, and a butyl group. Examples of the alkoxy group include, but are not limited to, a methoxy group and an ethoxy group.

Examples of the binder resin for use in the surface layer include, but are not limited to, poly(vinyl butyral) resin, polyarylate resin, polycarbonate resin, polyester resin, phenoxy resin, poly(vinyl acetate) resin, acrylic resin, polyacrylamide resin, polyamide resin, polyvinylpyridine, cellulose resin, urethane resin, epoxy resin, agarose resin, casein, poly(vinyl alcohol) resin, and polyvinylpyrrolidone.

Examples of the charge transporting substance for use in the surface layer include, but are not limited to, triarylamine compounds, hydrazone compounds, stilbene compounds, pyrazoline compounds, oxazole compounds, thiazole compounds, and triallylmethane compounds.

Examples of the solvent of the surface-layer coating solution include, but are not limited to, alcohol solvents, such as methanol, ethanol, and propanol, ketone solvents, such as acetone, methyl ethyl ketone, and cyclohexanone, ester solvents, such as ethyl acetate and butyl acetate, ether solvents, such as tetrahydrofuran and dioxane, halogen solvents, such as 1,1,2,2,3,3,4-heptafluorocyclopentane, dichloromethane, dichloroethane, and chlorobenzene, aromatic solvents, such as benzene, toluene, and xylene, and cellosolve solvents, such as methyl cellosolve and ethyl cellosolve. These solvents may be used alone or in combination.

A surface layer of an electrophotographic photosensitive member according to an embodiment of the present invention may contain various additive agents. Examples of the additive agents include, but are not limited to, antidegradants, such as antioxidants and ultraviolet absorbers, lubricants, such as polytetrafluoroethylene (PTFE) resin fine particles and fluorocarbons, and polymerization control agents, such as polymerization initiators and polymerization terminators.

The structure of an electrophotographic photosensitive member according to an embodiment of the present invention will be described below.

Support

A support (electroconductive support) for use in an electrophotographic photosensitive member according to an embodiment of the present invention may be made of a metal or alloy, such as aluminum, stainless steel, or nickel. The support may be a polyester or polycarbonate insulative substrate covered with a thin film made of a metal, such as aluminum or copper, or an electroconductive material, such as indium oxide or tin oxide. The support may contain electroconductive particles, such as carbon black, tin oxide particles, or titanium oxide particles, dispersed in a resin. The support may also be a plastic containing an electroconductive binder resin. The support may be cylindrical or a sheet. In order to prevent the occurrence of interference fringes, the support may have a rough surface. More specifically, the support may be subjected to cutting, surface roughening, or alumite treatment.

An electrophotographic photosensitive member according to an embodiment of the present invention may include an electroconductive layer between the support and the photosensitive layer or the intermediate layer. The electroconductive layer may be formed by applying an electroconductive-layer coating solution containing electroconductive particles and a resin to the support and drying the coating solution. The electroconductive layer contains a powder including the electroconductive particles. Examples of the electroconductive particles include, but are not limited to, carbon black, acetylene black, powders of metals, such as aluminum, zinc, copper, chromium, nickel, and silver, alloy powders, and powders of metal oxides, such as tin oxide and indium-tin oxide (ITO). In order to prevent the occurrence of interference fringes, the electroconductive layer may contain coarse particles.

Examples of the resin for use in the electroconductive layer include, but are not limited to, acrylic resin, alkyd resin, epoxy resin, phenolic resin, butyral resin, polyacetal resin, polyurethane, polyester, polycarbonate, and melamine resin.

Examples of the solvent for use in the electroconductive-layer coating solution include, but are not limited to, ether solvents, alcohol solvents, ketone solvents, and aromatic hydrocarbon solvents. The thickness of the electroconductive layer is preferably 0.2 μm or more and 40 μm or less, more preferably 5 μm or more and 40 μm or less.

An electrophotographic photosensitive member according to an embodiment of the present invention may include an intermediate layer between the support or the electroconductive layer and the photosensitive layer. The intermediate layer may be formed by applying an intermediate-layer coating solution containing a resin to the support or the electroconductive layer and drying or hardening the coating solution.

Examples of the resin for use in the intermediate layer include, but are not limited to, poly(vinyl alcohol) resin, poly-N-vinylimidazole resin, polyethylene oxide) resin, ethylcellulose, an ethylene-acrylic acid copolymer, casein, polyamide resin, N-methoxymethylated 6 nylon, copolymerized nylon, glue, and gelatin. The intermediate layer may contain the electroconductive particles described above.

A solvent for use in the intermediate-layer coating solution may be an ether solvent, an alcohol solvent, a ketone solvent, or an aromatic hydrocarbon solvent. The thickness of the intermediate layer is preferably 0.05 μm or more and 40 μm or less, more preferably in the range of 0.4 to 20 μm. The intermediate layer may contain semiconductive particles, an electron transporting substance, or an electron accepting substance.

Photosensitive Layer

An electrophotographic photosensitive member according to an embodiment of the present invention includes a photosensitive layer (a charge generating layer and a charge transporting layer) on the support, the electroconductive layer, or the intermediate layer.

Examples of the charge generating substance for use in an electrophotographic photosensitive member according to an embodiment of the present invention include, but are not limited to, pyrylium, thiapyrylium dyes, phthalocyanine compounds, anthanthrone pigments, dibenzpyrenequinone pigments, pyranthrone pigments, azo pigments, indigo pigments, quinacridone pigments, and quinocyanine pigments. The charge generating substance may be gallium phthalocyanine. Hydroxy gallium phthalocyanine crystals having strong peaks at Bragg angles 2θ of 7.4°±0.3° and 28.2°±0.3° in CuKα characteristic X-ray diffraction have high sensitivity.

The charge generating layer may be formed by applying a charge generating layer coating solution and drying the coating solution. The charge generating layer coating solution is prepared by dispersing a charge generating substance together with a binder resin and a solvent. The charge generating layer may also be an evaporated film of a charge generating substance.

Examples of the binder resin for use in a charge generating layer of a multilayer photosensitive layer according to an embodiment of the present invention include, but are not limited to, polymers and copolymers of vinyl compounds, such as styrene, vinyl acetate, and vinyl chloride, poly(vinyl alcohol) resin, poly(vinyl acetal) resin, poly(vinyl benzal) resin, polycarbonate resin, polyester resin, polysulfone resin, poly(phenylene oxide), polyurethane resin, cellulose resin, phenolic resin, melamine resin, silicon resin, and epoxy resin. These may be used alone or in combination as a mixture or a copolymer.

In the charge generating layer, the ratio of the binder resin to the charge generating substance may be 0.3 or more and 4 or less based on mass. The dispersion may be performed with a homogenizer, ultrasonic waves, a ball mill, a sand mill, an attritor, or a rolling mill.

Examples of the solvent for use in the charge generating layer coating solution include, but are not limited to, alcohol solvents, sulfoxide solvents, ketone solvents, ether solvents, ester solvents, and aromatic hydrocarbon solvents. The thickness of the charge generating layer is preferably 0.01 μm or more and 5 μm or less, more preferably 0.1 μm or more and 1 μm or less. The charge generating layer may contain an intensifier, an antioxidant, an ultraviolet absorber, and/or a plasticizer, if necessary.

In an electrophotographic photosensitive member having a multilayer photosensitive layer, a charge transporting layer is formed on a charge generating layer. In the case that the charge transporting layer is the surface layer as illustrated in FIG. 1A, the charge transporting layer can be formed by forming a coat on the charge generating layer by the use of a charge transporting layer coating solution and drying the coat. The charge transporting layer coating solution contains a urea compound according to an embodiment of the present invention, a charge transporting substance, and a binder resin, dissolved in a solvent. Alternatively, the charge transporting layer can be formed by forming a coat on the charge generating layer by the use of a charge transporting layer coating solution that contains a urea compound according to an embodiment of the present invention and a charge transporting substance having a chain-polymerizable functional group dissolved in a solvent and polymerizing the charge transporting substance. In the case that a protective layer formed on a charge transporting layer is the surface layer, the charge transporting layer may be formed by forming a coat on the charge generating layer by the use of a charge transporting layer coating solution that contains a charge transporting substance and a binder resin and drying the coat.

The charge transporting substance for use in the charge transporting layer may be the same as the charge transporting substance for use in the surface layer.

The charge transporting substance having a chain-polymerizable functional group for use in the charge transporting layer may be the same as the charge transporting substance having a chain-polymerizable functional group for use in the surface layer. The charge transporting substance having a chain-polymerizable functional group may constitute 20% by mass or more and 99% by mass or less of the total solids of the charge transporting layer coating solution.

The binder resin for use in the charge transporting layer of a multilayer photosensitive layer may be the same as the binder resin for use in the surface layer.

The percentage of the charge transporting substance may be 30% by mass or more and 70% by mass or less of the total mass of the charge transporting layer.

Examples of the solvent for use in the charge transporting layer coating solution include, but are not limited to, ether solvents, alcohol solvents, ketone solvents, and aromatic hydrocarbon solvents. The thickness of the charge transporting layer may be 5 μm or more and 40 μm or less.

In accordance with an embodiment of the present invention, a protective layer may be formed on the charge transporting layer. The protective layer may be formed by forming a coat on the charge transporting layer by the use of a protective layer coating solution that contains a binder resin, a urea compound according to an embodiment of the present invention, and optionally a charge transporting substance and drying the coat. Alternatively, the protective layer may be formed by forming a coat on the charge transporting layer by the use of a protective layer coating solution that contains a charge transporting substance having a chain-polymerizable functional group and a urea compound according to an embodiment of the present invention and polymerizing the charge transporting substance.

The charge transporting substance for use in the protective layer may be the same as the charge transporting substance for use in the surface layer. The percentage of the charge transporting substance may be 30% by mass or more and 70% by mass or less of the total mass of the protective layer.

The binder resin for use in the protective layer may be the same as the binder resin for use in the surface layer.

The charge transporting substance having a chain-polymerizable functional group for use in the protective layer may be the same as the charge transporting substance having a chain-polymerizable functional group for use in the surface layer. The charge transporting substance having a chain-polymerizable functional group may constitute 20% by mass or more and 99% by mass or less of the total solids of the protective layer coating solution.

The thickness of the protective layer may be 5 μm or more and 20 μm or less.

These coating solutions may be applied by dip coating (dipping), spray coating, spinner coating, bead coating, blade coating, or beam coating.

A polymerization reaction in the formation of the surface layer will be described below. The surface layer may be formed by forming a coat by the use of a surface-layer coating solution that contains a urea compound and a charge transporting substance having a chain-polymerizable functional group and polymerizing the charge transporting substance.

The charge transporting substance having a chain-polymerizable functional group may be polymerized utilizing heat, light (such as ultraviolet rays), or radioactive rays (such as an electron ray). The compound may be polymerized utilizing radioactive rays, such as an electron ray.

Polymerization utilizing an electron ray can produce a three-dimensional network structure having a very high density and achieve excellent electric potential stability. Because of short and efficient polymerization, polymerization utilizing an electron ray has high productivity. An accelerator of an electron ray may be of a scanning type, an electrocurtain type, a broad beam type, a pulse type, or a laminar type.

The following are the conditions for electron ray irradiation. In embodiments of the present invention, the accelerating voltage is preferably 120 kV or less, more preferably 80 kV or less. The electron ray absorbed dose is preferably in the range of $1\times10^3$ to $1\times10^5$ Gy, more preferably $5\times10^3$ to $5\times10^4$ Gy.

In order to prevent oxygen from inhibiting electron ray polymerization of a charge transporting substance having a chain-polymerizable functional group, electron ray irradiation in an inert gas atmosphere can be followed by heating in an inert gas atmosphere. Examples of the inert gas include, but are not limited to, nitrogen, argon, and helium.

Figure 2:
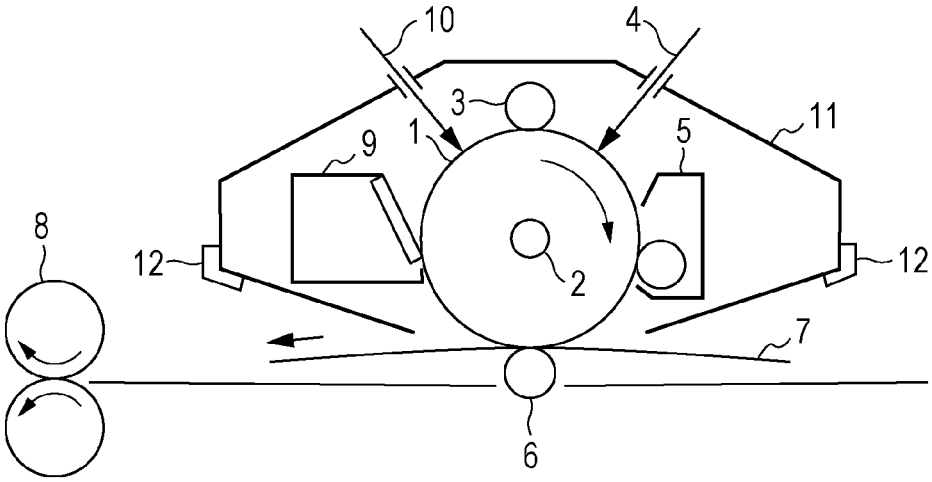
FIG. 2 is a schematic view of an electrophotographic apparatus that includes a process cartridge including an electrophotographic photosensitive member according to an embodiment of the present invention.

FIG. 2 is a schematic view of an electrophotographic apparatus that includes a process cartridge including an electrophotographic photosensitive member according to an embodiment of the present invention.

In FIG. 2, a drum-type electrophotographic photosensitive member 1 according to an embodiment of the present invention is rotated around a shaft 2 in the direction of the arrow at a predetermined peripheral speed (process speed). During the rotation, the surface of the electrophotographic photosensitive member 1 is uniformly positively or negatively charged at a predetermined potential by a charging device (primary charging device) 3. The electrophotographic photosensitive member 1 is then irradiated with intensity-modulated exposure light 4 emitted from an exposure device (not shown), such as a slit exposure device or a laser beam scanning exposure device, in response to the time-series electric digital image signals of intended image information. In this way, electrostatic latent images corresponding to the intended image information are successively formed on the surface of the electrophotographic photosensitive member 1.

The electrostatic latent images are then subjected to normal or reversal development with a toner in a developing device 5 to be made visible as toner images. The toner images on the electrophotographic photosensitive member 1 are successively transferred to a transferring member 7 by a transferring device 6. The transferring member 7 taken from a paper feeder (not shown) in synchronism with the rotation of the electrophotographic photosensitive member 1 is fed between the electrophotographic photosensitive member 1 and the transferring device 6. A bias voltage having polarity opposite to the polarity of the electric charges of the toner is applied to the transferring device 6 with a bias power supply (not shown). The transferring device may be an intermediate transfer device that includes a primary transfer member, an intermediate transfer member, and a secondary transfer member.

The transferring member 7 is then separated from the electrophotographic photosensitive member and is transported to a fixing device 8. After the toner images are fixed, the transferring member 7 is output from the electrophotographic apparatus as an image-formed article (such as a print or a copy).

Deposits, such as residual toner, on the surface of the electrophotographic photosensitive member 1 after the toner images have been transferred are removed with a cleaning device 9. The residual toner may be recovered with the developing device 5. If necessary, the electrophotographic photosensitive member 1 is again used in image forming after the electricity is removed with pre-exposure light 10 from a pre-exposure device (not shown). In the case that the charging device 3 is a contact charging device, such as a charging roller, pre-exposure is not necessarily required.

A plurality of components selected from the electrophotographic photosensitive member 1, the charging device 3, the developing device 5, the transferring device 6, and the cleaning device 9 may be housed in a container to provide a process cartridge. The process cartridge may be detachably attached to the main body of an electrophotographic apparatus, such as a copying machine or a laser-beam printer. For example, at least one device selected from the group consisting of the charging device 3, the developing device 5, the transferring device 6, and the cleaning device 9 may be integrally supported together with the electrophotographic photosensitive member 1 to provide a process cartridge 11, which is detachably attachable to the main body of an electrophotographic apparatus through a guide unit 12, such as rails.

EXAMPLES

The present invention will be further described in the following examples and comparative examples. The term "part" in the examples means "part by mass".

Example 1

An aluminum cylinder having a diameter of 30 mm, a length of 357.5 mm, and a thickness of 1 mm was used as an electroconductive support.

50 parts of titanium oxide particles covered with tin oxide containing 10% antimony oxide (trade name: ECT-62, manufactured by Titan Kogyo, Ltd.), 25 parts of a resole phenolic resin (trade name: Phenolite J-325, manufactured by Dainippon Ink and Chemicals, Inc., solid content 70% by mass), 20 parts of methyl cellosolve, 5 parts of methanol, and 0.002 parts of a silicone oil (a polydimethylsiloxane-polyoxyalkylene copolymer having an average molecular weight of 3000) were dispersed for two hours with a sand mill using glass beads having a diameter of 0.8 mm to prepare an electroconductive-layer coating solution.

The electroconductive-layer coating solution was applied to the support by dip coating and was dried at 140° C. for 30 minutes to form an electroconductive layer having a thickness of 15 μm.

2.5 parts of a nylon 6-66-610-12 quaterpolymer resin (trade name: CM8000, manufactured by Toray Industries, Inc.) and 7.5 parts of an N-methoxymethylated 6 nylon resin (trade name: Toresin EF-30T, manufactured by Nagase ChemteX Corp.) were dissolved in a mixed solvent of 100 parts of methanol and 90 parts of butanol to prepare an intermediate-layer coating solution.

The intermediate-layer coating solution was applied to the electroconductive layer by dip coating and was dried at 100° C. for 10 minutes to form an intermediate layer having a thickness of 0.7 μm.

11 parts of hydroxy gallium phthalocyanine crystals (a charge generating substance) were prepared. The crystals had strong peaks at Bragg angles (2θ±0.2°) of 7.4° and 28.2° in CuKα characteristic X-ray diffraction. A mixture of 5 parts of a poly(vinyl butyral) resin (trade name: S-LecBX-1, manufactured by Sekisui Chemical Co., Ltd.) and 130 parts of cyclohexanone was dispersed with 500 parts of glass beads having a diameter of 1 mm at 1800 rpm for two hours while the mixture was cooled with cooling water at 18° C. After dispersion, the mixture was diluted with 300 parts of ethyl acetate and 160 parts of cyclohexanone to prepare a charge generating layer coating solution.

The average particle size (median) of the hydroxy gallium phthalocyanine crystals in the charge generating layer coating solution was 0.18 μm as measured with a centrifugal particle size analyzer (trade name: CAPA-700) manufactured by Horiba, Ltd., the principle of which is based on liquid phase sedimentation.

The charge generating layer coating solution was applied to the intermediate layer by dip coating and was dried at 110° C. for 10 minutes to form a charge generating layer having a thickness of 0.17 μm.

5 parts of a compound represented by the following formula (6) (a charge transporting substance), 5 parts of a compound represented by the following formula (7) (a charge transporting substance), and 10 parts of a polycarbonate resin (trade name: Iupilon 2400, manufactured by Mitsubishi Gas Chemical Co., Inc.) were dissolved in a mixed solvent of 70 parts of monochlorobenzene and 30 parts of dimethoxymethane to prepare a charge transporting layer coating solution.

The charge transporting layer coating solution was applied to the charge generating layer by dip coating and was dried at 100° C. for 30 minutes to form a charge transporting layer having a thickness of 18 μm.

(6)

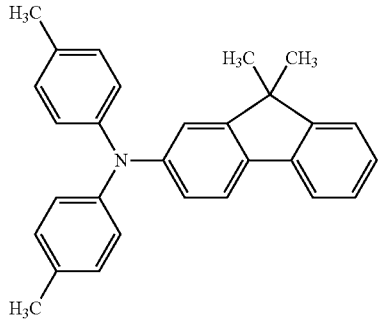

(7)

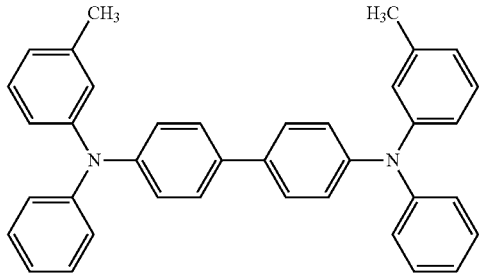

97 parts of a compound represented by the following formula (8) and 3 parts of the exemplary compound (TU-8) were dissolved in 100 parts of n-propanol. 100 parts of 1,1,2,2,3,3,4-heptafluorocyclopentane (trade name: Zeorora H, manufactured by Zeon Corp.) was added to the solution to prepare a protective layer coating solution.

(8)

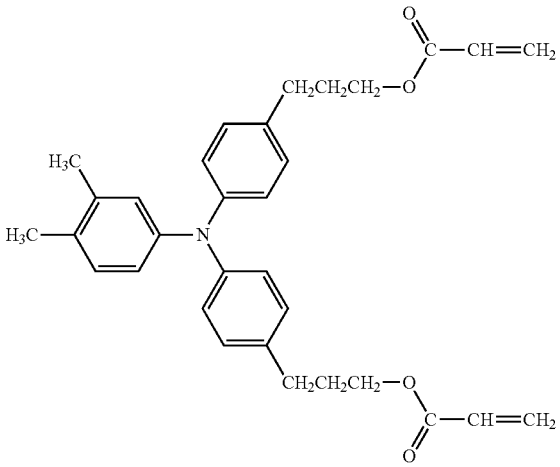

The protective layer coating solution was applied to the charge transporting layer by dip coating, and the resulting coat was heat-treated at 50° C. for five minutes. The coat was then irradiated with an electron ray for 1.6 seconds in a nitrogen atmosphere at an accelerating voltage of 80 kV and an absorbed dose of $1.9\times10^4$ Gy. The coat was then heat-treated at 125° C. for 30 seconds in a nitrogen atmosphere. The processes from the electron ray irradiation to the 30-second heat treatment were performed at an oxygen concentration of 19 ppm. The coat was then heat-treated at 110° C. for 20 minutes in the atmosphere to form a protective layer having a thickness of 5 μm.

In this manner, an electrophotographic photosensitive member was produced. The electrophotographic photosensitive member included the support, the electroconductive layer, the intermediate layer, the charge generating layer, the charge transporting layer, and the protective layer. The protective layer was the surface layer.

Example 2

An electrophotographic photosensitive member was produced in the same manner as in Example 1 except that the protective layer coating solution was prepared using the exemplary compound (TU-7) instead of the exemplary compound (TU-8).

Example 3

An electrophotographic photosensitive member was produced in the same manner as in Example 1 except that the protective layer coating solution was prepared using the exemplary compound (DU-7) instead of the exemplary compound (TU-8).

Example 4

An electrophotographic photosensitive member was produced in the same manner as in Example 1 except that the protective layer coating solution was prepared using the exemplary compound (TU-6) instead of the exemplary compound (TU-8).

Example 5

An electrophotographic photosensitive member was produced in the same manner as in Example 1 except that the protective layer coating solution was prepared using the exemplary compound (DU-6) instead of the exemplary compound (TU-8).

Example 6

An electrophotographic photosensitive member was produced in the same manner as in Example 1 except that the protective layer coating solution was prepared using the exemplary compound (TU-4) instead of the exemplary compound (TU-8).

Example 7

An electrophotographic photosensitive member was produced in the same manner as in Example 1 except that the protective layer coating solution was prepared using the exemplary compound (DU-4) instead of the exemplary compound (TU-8).

Example 8

An electrophotographic photosensitive member was produced in the same manner as in Example 1 except that the protective layer coating solution was prepared using the exemplary compound (TeU-5) instead of the exemplary compound (TU-8).

Example 9

An electrophotographic photosensitive member was produced in the same manner as in Example 1 except that the protective layer coating solution was prepared using the exemplary compound (DU-5) instead of the exemplary compound (TU-8).

Example 10

An electrophotographic photosensitive member was produced in the same manner as in Example 1 except that the protective layer coating solution was prepared using the exemplary compound (TeU-3) instead of the exemplary compound (TU-8).

Example 11

An electrophotographic photosensitive member was produced in the same manner as in Example 1 except that the protective layer coating solution was prepared using the exemplary compound (DU-3) instead of the exemplary compound (TU-8).

Example 12

An electrophotographic photosensitive member was produced in the same manner as in Example 1 except that the protective layer coating solution was prepared using the exemplary compound (TeU-1) instead of the exemplary compound (TU-8).

Example 13

An electrophotographic photosensitive member was produced in the same manner as in Example 1 except that the protective layer coating solution was prepared using the exemplary compound (DU-1) instead of the exemplary compound (TU-8).

Example 14

An electrophotographic photosensitive member was produced in the same manner as in Example 1 except that the protective layer coating solution was prepared using the exemplary compound (TeU-2) instead of the exemplary compound (TU-8).

Example 15

An electrophotographic photosensitive member was produced in the same manner as in Example 1 except that the protective layer coating solution was prepared using the exemplary compound (TU-2) instead of the exemplary compound (TU-8).

Example 16

An electrophotographic photosensitive member was produced in the same manner as in Example 1 except that the protective layer coating solution was prepared using the exemplary compound (DU-2) instead of the exemplary compound (TU-8).

Example 17

An electrophotographic photosensitive member was produced in the same manner as in Example 1 except that the protective layer coating solution was prepared using 1 part of the exemplary compound (DU-2) instead of 3 parts of the exemplary compound (TU-8).

Example 18

An electrophotographic photosensitive member was produced in the same manner as in Example 16 except that the protective layer coating solution was prepared using a compound represented by the following formula (9) instead of the compound represented by the formula (8).

(9)

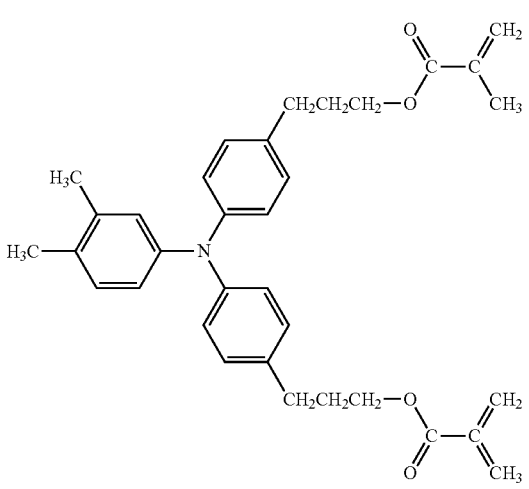

Example 19

An electrophotographic photosensitive member was produced in the same manner as in Example 16 except that the protective layer coating solution was prepared using a compound represented by the following formula (10) instead of the compound represented by the formula (8).

(10)

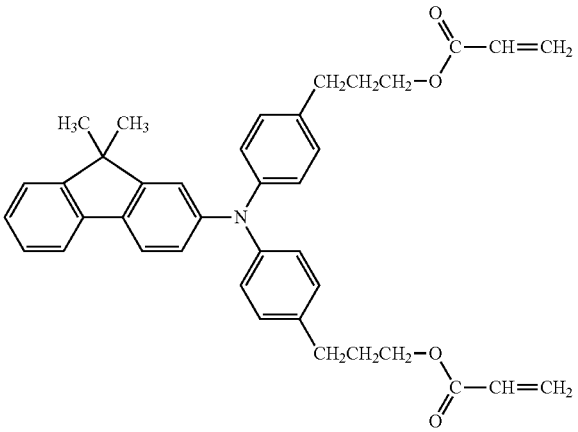

Example 20

An electrophotographic photosensitive member was produced in the same manner as in Example 1 except that the protective layer coating solution was prepared by dissolving 48.5 parts of trimethylolpropane triacrylate (trade name: TMPTA, manufactured by Daicel-Cytec Co., Ltd.) (a compound having an acryloyl group as a polymerizable functional group and no charge transporting structure), 48.5 parts of a compound represented by the following formula (11), and 3 parts of the exemplary compound (DU-2) in 25 parts of n-propanol and adding 25 parts of 1,1,2,2,3,3,4-heptafluorocyclopentane (trade name: Zeorora H, manufactured by Zeon Corp.) to the solution.

(11)

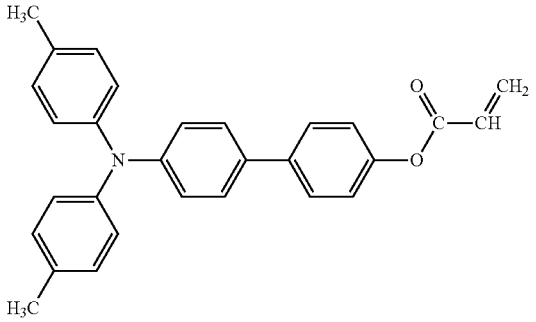

Example 21

An electrophotographic photosensitive member was produced in the same manner as in Example 16 except that the protective layer coating solution was prepared by adding 97 parts of the compound represented by the formula (8), 3 parts of the exemplary compound (DU-2), 19 parts of polytetrafluoroethylene particles (trade name: Lubron L2, manufactured by Daikin Industries, Ltd.), and 1 part of a resin (having a weight-average molecular weight of 130,000) having a constitutional repeating unit represented by the following formula (A1) and a constitutional repeating unit represented by the following formula (A2) (a copolymerization ratio (A1)/(A2)=1/1 (molar ratio)) to a mixed solvent of 100 parts of n-propanol and 100 parts of 1,1,2,2,3,3,4-heptafluorocyclopentane (trade name: Zeorora H, manufactured by Zeon Corp.) and dispersing the mixture with an ultrahigh pressure disperser.

(A1)

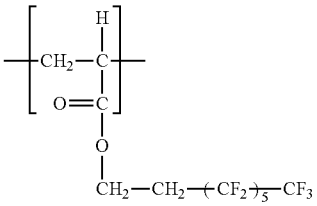

(A2)

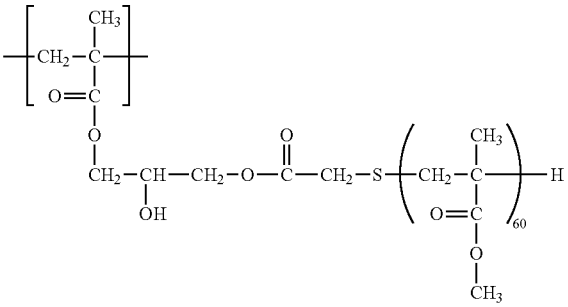

Comparative Example 1

An electrophotographic photosensitive member was produced in the same manner as in Example 1 except that the protective layer coating solution was prepared without using the exemplary compound (TU-8).

Comparative Example 2

An electrophotographic photosensitive member was produced in the same manner as in Example 1 except that the protective layer coating solution was prepared using a compound represented by the following formula (B) instead of the exemplary compound (TU-8).

(B)

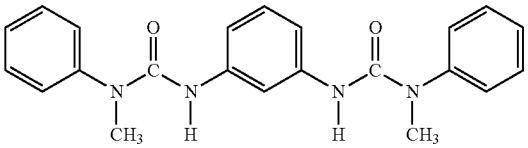

Comparative Example 3

An electrophotographic photosensitive member was produced in the same manner as in Example 1 except that the protective layer coating solution was prepared using a compound represented by the following formula (C) instead of the exemplary compound (TU-8).

(C)

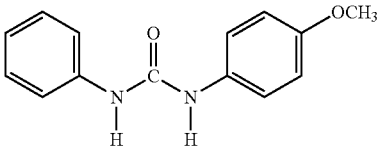

Comparative Example 4

An electrophotographic photosensitive member was produced in the same manner as in Example 1 except that the protective layer coating solution was prepared using a compound represented by the following formula (D) instead of the exemplary compound (TU-8).

(D)

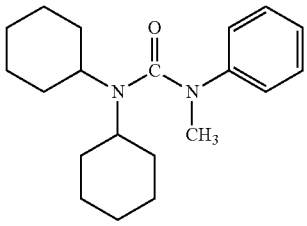

Comparative Example 5

An electrophotographic photosensitive member was produced in the same manner as in Example 1 except that the protective layer coating solution was prepared using a compound represented by the following formula (E) instead of the exemplary compound (TU-8).

(E)

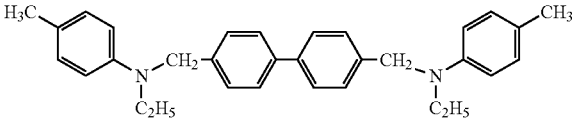

Comparative Example 6

An electrophotographic photosensitive member was produced in the same manner as in Example 18 except that the protective layer coating solution was prepared using the compound represented by the formula (E) instead of the exemplary compound (DU-2).

Comparative Example 7

An electrophotographic photosensitive member was produced in the same manner as in Example 19 except that the protective layer coating solution was prepared using the compound represented by the formula (D) instead of the exemplary compound (DU-2).

Comparative Example 8

An electrophotographic photosensitive member was produced in the same manner as in Example 20 except that the protective layer coating solution was prepared using the compound represented by the formula (D) instead of the exemplary compound (DU-2).

Comparative Example 9

An electrophotographic photosensitive member was produced in the same manner as in Example 1 except that the protective layer coating solution was prepared using a compound represented by the following formula (F) instead of the exemplary compound (TU-8).

(F)

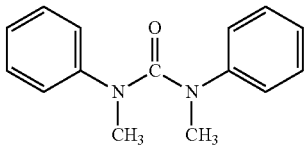

Comparative Example 10

An electrophotographic photosensitive member was produced in the same manner as in Example 1 except that the protective layer coating solution was prepared using a compound represented by the following formula (G) instead of the exemplary compound (TU-8).

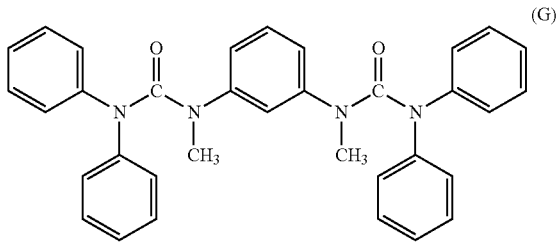

(G)

Evaluation Method

The electrophotographic photosensitive members according to Examples 1 to 21 and Comparative Examples 1 to 8 were evaluated in the following manner. The electric potential stability of the electrophotographic photosensitive members was evaluated with respect to the variation in light area potential. Image deletion was evaluated with respect to image quality after repeated use of an electrophotographic photosensitive member.

Variation in Light Area Potential

An electrophotographic copying machine GP-405 (manufactured by CANON KABUSHIKI KAISHA) was used after modified such that a corona charger could be connected to an external power supply. The GP-405 was further modified such that the corona charger could be attached to a drum cartridge. A charger for an electrophotographic copying machine GP-55 (manufactured by CANON KABUSHIKI KAISHA) was used as the corona charger. The electrophotographic photosensitive member was attached to the drum cartridge, which was attached to the modified GP-405. The variation in light area potential was evaluated as described below. A heater (drum heater (cassette heater)) for the electrophotographic photosensitive member was in the OFF position during the evaluation.

The surface potential of the electrophotographic photosensitive member was measured by removing a developing unit from the main body of the electrophotographic copying machine and fixing a potential measuring probe (model 6000B-8, manufactured by Trek Japan) at a position of development. A transferring unit was not in contact with the electrophotographic photosensitive member, and a paper sheet was not fed while measuring the surface potential.

The charger was connected to an external power supply. The power supply was controlled with a high-voltage supply controller (Model 610C, manufactured by Trek Inc.) such that the discharge current was 500 μA. The constant-current control scorotron grid applied voltage and light exposure conditions were controlled such that the electrophotographic photosensitive member had an initial dark area potential (Vd) of approximately −650 (V) and an initial light area potential (Vl) of approximately −200 (V).

The electrophotographic photosensitive member was installed in the copying machine. An image having an image ratio of 5% was printed on 1000 pieces of A4-size portrait paper at a temperature of 30° C. and a humidity of 80% RH. After that, the light area potential (Vl) was measured, and the potential variation ΔVl relative to the initial light area potential was calculated. Table 1 shows the results.

Image Quality after Repeated Use of Electrophotographic Photosensitive Member

After the evaluation of potential variation, the electrophotographic photosensitive member was again installed in the copying machine. After an image having an image ratio of 5% was printed on 9000 pieces of A4-size portrait paper (10,000 in total), the supply of electricity to the copying machine was stopped, and the copying machine was suspended for 72 hours. After 72 hours, electricity was again supplied to the copying machine. A lattice image (4 lines, 40 spaces) and a character image (E character image) consisting of letter E's of the alphabet (font: Times, font size 6-point) were printed on A4-size portrait paper.

Likewise, after printing of an additional 40,000 (50,000 in total) and 50,000 (100,000 in total) pieces of paper, the supply of electricity to the copying machine was stopped, and the copying machine was suspended for 72 hours. In each case, electricity was again supplied to the copying machine after 72 hours, and the lattice image and the E character image were printed on A4-size portrait paper.

The printed images were rated in accordance with the following criteria. Levels 5, 4, and 3 have the advantages of the present invention, and level 5 is excellent. Levels 1 and 2 lack the advantages of the present invention. Table 1 shows the results.

Level 5: Both the lattice image and the E character image have no image defect.

Level 4: The lattice image is partly blurred, but the E character image has no image defect.

Level 3: The lattice image is partly blurred, and the E character image is partly thin.

Level 2: The lattice image is partly lost, and the E character image is thin over the entire surface.

Level 1: The lattice image is lost over the entire surface, and the E character image is thin over the entire surface.

TABLE 1

| | Paper feed durability evaluation | | | |
|---|---|---|---|---|
| | Variation in light area potential after printing on 1000 pieces of paper (V) | Image level after printing on 10000 pieces of paper | Image level after printing on 50000 pieces of paper | Image level after printing on 100000 pieces of paper |
| Example 1 | 50 | 4 | 3 | 3 |
| Example 2 | 50 | 4 | 3 | 3 |
| Example 3 | 50 | 4 | 3 | 3 |
| Example 4 | 35 | 4 | 3 | 3 |
| Example 5 | 35 | 4 | 3 | 3 |
| Example 6 | 35 | 4 | 3 | 3 |
| Example 7 | 35 | 4 | 3 | 3 |
| Example 8 | 35 | 4 | 4 | 3 |
| Example 9 | 35 | 4 | 4 | 3 |
| Example 10 | 35 | 4 | 4 | 4 |
| Example 11 | 35 | 4 | 4 | 4 |
| Example 12 | 30 | 4 | 4 | 4 |
| Example 13 | 30 | 4 | 4 | 4 |
| Example 14 | 25 | 5 | 5 | 4 |
| Example 15 | 25 | 5 | 5 | 4 |
| Example 16 | 25 | 5 | 5 | 4 |
| Example 17 | 25 | 5 | 5 | 4 |
| Example 18 | 25 | 5 | 5 | 4 |
| Example 19 | 30 | 5 | 5 | 4 |
| Example 20 | 50 | 5 | 5 | 4 |
| Example 21 | 25 | 5 | 5 | 4 |
| Comparative example 1 | 25 | 2 | 1 | 1 |
| Comparative example 2 | 85 | 2 | 2 | 1 |
| Comparative example 3 | 85 | 2 | 2 | 1 |
| Comparative example 4 | 60 | 2 | 2 | 1 |
| Comparative example 5 | 75 | 2 | 2 | 1 |
| Comparative example 6 | 75 | 2 | 2 | 1 |

TABLE 1-continued

| | Paper feed durability evaluation | | | |
|---|---|---|---|---|
| | Variation in light area potential after printing on 1000 pieces of paper (V) | Image level after printing on 10000 pieces of paper | Image level after printing on 50000 pieces of paper | Image level after printing on 100000 pieces of paper |
| Comparative example 7 | 80 | 2 | 2 | 1 |
| Comparative example 8 | 100 | 2 | 2 | 1 |
| Comparative example 9 | 25 | 2 | 2 | 2 |
| Comparative example 10 | 45 | 2 | 2 | 1 |

Example 22

An electrophotographic photosensitive member that included a charge transporting layer as a surface layer was produced in the same manner as in Example 1 except that 0.2 parts of the exemplary compound (DU-2) was added to the charge transporting layer coating solution prepared in Example 1 and that the protective layer was not formed.

Example 23

An electrophotographic photosensitive member was produced in the same manner as in Example 22 except that the amount of exemplary compound (DU-2) added was 1 part.

Example 24

An electrophotographic photosensitive member was produced in the same manner as in Example 22 except that the amount of exemplary compound (DU-2) added was 4 parts.

Example 25

An electrophotographic photosensitive member was produced in the same manner as in Example 22 except that the charge transporting layer coating solution was prepared by the addition of 0.5 parts of the exemplary compound (DU-2) and 0.5 parts of the exemplary compound (DU-1).

Example 26

An electrophotographic photosensitive member was produced in the same manner as in Example 25 except that the charge transporting layer coating solution was prepared using 10 parts of a compound represented by the following formula (12) instead of 5 parts of the compound represented by the formula (6) and 5 parts of the compound represented by the formula (7).

(12)

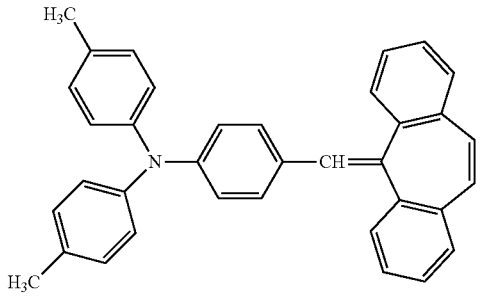

Comparative Example 11

An electrophotographic photosensitive member was produced in the same manner as in Example 1 except that the protective layer was not formed.

Comparative Example 12

An electrophotographic photosensitive member was produced in the same manner as in Example 26 except that the protective layer was not formed.

Comparative Example 13

An electrophotographic photosensitive member was produced in the same manner as in Comparative Example 11 except that the charge transporting layer coating solution was prepared by the addition of 1 part of the compound represented by the formula (B).

Comparative Example 14

An electrophotographic photosensitive member was produced in the same manner as in Comparative Example 11 except that the charge transporting layer coating solution was prepared by the addition of 1 part of the compound represented by the formula (C).

Comparative Example 15

An electrophotographic photosensitive member was produced in the same manner as in Comparative Example 11 except that the charge transporting layer coating solution was prepared by the addition of 1 part of the compound represented by the formula (D).

Comparative Example 16

An electrophotographic photosensitive member was produced in the same manner as in Comparative Example 11 except that the charge transporting layer coating solution was prepared by the addition of 1 part of the compound represented by the formula (E).

Evaluation Method

The electrophotographic photosensitive members according to Examples 22 to 26 and Comparative Examples 11 to 16 were evaluated in the following manner. The electric potential stability of the electrophotographic photosensitive members was evaluated with respect to the variation in light area potential. The variation in light area potential was evaluated as described above. Image deletion was evaluated with respect to image quality after repeated use of an electrophotographic photosensitive member. Table 2 shows the results.

Image Quality after Repeated Use of Electrophotographic Photosensitive Member

After the evaluation of potential variation, the electrophotographic photosensitive member was again installed in the copying machine. After an image having an image ratio of 5% was printed on 9000 pieces of A4-size portrait paper (10,000 in total), the supply of electricity to the copying machine was stopped, and the copying machine was suspended for 72 hours. Electricity was again supplied to the copying machine after 72 hours. The lattice image and the E character image were printed on A4-size portrait paper.

Likewise, after printing of an additional 40,000 (50,000 in total) pieces of paper, the supply of electricity to the copying machine was stopped, and the copying machine was suspended for 72 hours. In each case, electricity was again supplied to the copying machine after 72 hours, and the lattice image and the E character image were printed on A4-size portrait paper.

The printed images were rated levels 1 to 5 in accordance with the criteria described above. Table 2 shows the results.

TABLE 2

| | Paper feed durability evaluation | | |
|---|---|---|---|
| | Variation in light area potential after printing on 1000 pieces of paper (V) | Image level after printing on 10000 pieces of paper | Image level after printing on 50000 pieces of paper |
| Example 22 | 20 | 5 | 5 |
| Example 23 | 20 | 5 | 5 |
| Example 24 | 20 | 5 | 5 |
| Example 25 | 20 | 5 | 5 |
| Example 26 | 30 | 5 | 5 |
| Comparative example 11 | 20 | 2 | 1 |
| Comparative example 12 | 30 | 2 | 1 |
| Comparative example 13 | 80 | 2 | 2 |
| Comparative example 14 | 80 | 2 | 2 |
| Comparative example 15 | 55 | 2 | 2 |
| Comparative example 16 | 70 | 2 | 2 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-115862 filed May 24, 2011 and No. 2012-100965 filed Apr. 26, 2012, which are hereby incorporated by reference herein in their entirety.

What is claimed is:

1. An electrophotographic photosensitive member, comprising:

a support, a photosensitive layer provided on the support;

wherein the electrophotographic photosensitive member comprises a surface layer comprising a urea compound, the urea compound is at least one compound selected from the group consisting of a compound represented by the following formula (1), a compound represented by the following formula (2), and a compound represented by the following formula (3); and (1)

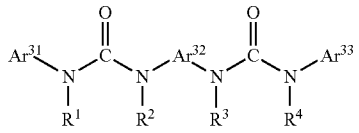

(2)

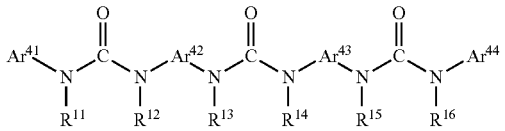

(3)

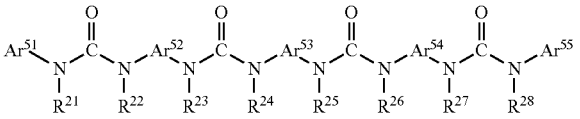

wherein, in the formulas (1) to (3), $R^1$ to $R^4$, $R^{11}$ to $R^{16}$, and $R^{21}$ to $R^{28}$ each independently represents an alkyl group, $Ar^{32}$, $Ar^{42}$ to $Ar^{43}$, and $Ar^{52}$ to $Ar^{54}$ each independently represents an unsubstituted or substituted arylene group, $Ar^{31}$, $Ar^{33}$, $Ar^{41}$, $Ar^{44}$, $Ar^{51}$, and $Ar^{55}$ each independently represents an unsubstituted or substituted aryl group, a substituent group of the substituted arylene group is an alkyl group, an alkoxy-substituted alkyl group, a halogen-substituted alkyl group, an alkoxy group, an alkoxy-substituted alkoxy group, a halogen-substituted alkoxy group, or a halogen atom, a substituent group of the substituted aryl group is a cyano group, a dialkylamino group, a hydroxy group, an alkyl group, an alkoxy-substituted alkyl group, a halogen-substituted alkyl group, an alkoxy group, an alkoxy-substituted alkoxy group, a halogen-substituted alkoxy group, a nitro group, or a halogen atom.

2. An electrophotographic photosensitive member according to claim 1, wherein, in the formulas (1) to (3), the substituent group of the substituted aryl group is a methyl group, an ethyl group, a n-propyl group, a trifluoromethyl group, a methoxy group, a dimethylamino group, or a fluorine atom.

3. An electrophotographic photosensitive member according to claim 1, wherein, in the formulas (1) to (3), $Ar^{31}$, $Ar^{33}$, $Ar^{41}$, $Ar^{44}$, $Ar^{51}$, and $Ar^{55}$ is a phenyl group.

4. An electrophotographic photosensitive member according to claim 1, wherein, in the formulas (1) to (3), $R^1$ to $R^4$, $R^{11}$ to $R^{16}$, and $R^{21}$ to $R^{28}$ each independently represents a methyl group, an ethyl group, or a n-propyl group.

5. An electrophotographic photosensitive member according to claim 1, wherein, in the formulas (1) to (3), $Ar^{32}$, $Ar^{42}$ to $Ar^{43}$, and $Ar^{52}$ to $Ar^{54}$ each independently represents a phenylene group.

6. An electrophotographic photosensitive member according to claim 1, wherein the compound represented by the formula (1) is a compound represented by the following formula (DU-2)

(DU-2)

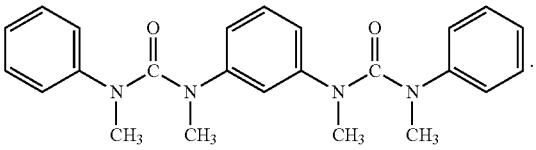

7. An electrophotographic photosensitive member according to claim 1, wherein the surface layer comprises a polymer polymerized a compound with two or more chain-polymerizable functional groups in the same molecule.

8. A process cartridge detachably attachable to a main body of an electrophotographic apparatus, wherein the process cartridge integrally supports:

the electrophotographic photosensitive member according to claim 1; and at least one device selected from the group consisting of a charging device, a developing device, a transferring device, and a cleaning device.

9. An electrophotographic apparatus comprising:

the electrophotographic photosensitive member according to claim 1;

a charging device;

an exposure device;

a developing device; and a transferring device.

10. An electrophotographic photosensitive member according to claim 1, wherein the photosensitive layer comprises:

a charge generating layer, and a charge transporting layer.

11. An electrophotographic photosensitive member according to claim 1, wherein the urea compound is at least one compound selected from the group consisting of the compound represented by the formula (2) and the compound represented by the formula (3).

* * * * *